US006480091B1

(12) United States Patent
Scott et al.

(10) Patent No.: US 6,480,091 B1
(45) Date of Patent: Nov. 12, 2002

(54) THERMAL SWITCH WITH ACTIVATION INDICATOR

(75) Inventors: Byron G. Scott, Arlington, WA (US); George D. Davis, Bellevue, WA (US)

(73) Assignee: Honeywell International, Inc.

( * ) Notice: Subject to any disclaimer, the term of this patent is extended or adjusted under 35 U.S.C. 154(b) by 143 days.

(21) Appl. No.: 09/596,184

(22) Filed: Jun. 16, 2000

Related U.S. Application Data

(63) Continuation-in-part of application No. 09/205,669, filed on Dec. 4, 1998, now Pat. No. 6,114,941.
(60) Provisional application No. 60/067,956, filed on Dec. 8, 1997.

(51) Int. Cl.[7] ..... H01H 71/04; H01H 37/08; H01H 9/16

(52) U.S. Cl. ..... 337/332; 337/79; 116/206; 116/207; 200/308

(58) Field of Search ..... 337/332, 79, 241, 337/243, 265; 116/216, 206, 207; 200/308

(56) References Cited

U.S. PATENT DOCUMENTS 1,014,741 A * 1/1912 Barringer et al. ..... 337/243
2,695,347 A * 11/1954 Brautigam ..... 337/343
2,945,305 A * 7/1960 Strickler ..... 434/300
3,394,334 A * 7/1968 Wright et al. ..... 337/241
3,997,862 A * 12/1976 Kozacka et al. ..... 337/241
4,127,837 A * 11/1978 Borchart ..... 337/265
4,206,308 A * 6/1980 Murakami et al. ..... 546/347
4,308,516 A * 12/1981 Shimada et al. ..... 337/241
4,339,207 A * 7/1982 Hof et al. ..... 374/160
4,464,064 A * 8/1984 D'Luzansky ..... 374/101
4,538,926 A * 9/1985 Chretien ..... 374/150
4,929,090 A * 5/1990 Grahm ..... 374/102
5,094,545 A * 3/1992 Larsson et al. ..... 374/160
5,484,205 A * 1/1996 Grupp et al. ..... 374/142
5,665,443 A * 9/1997 Hata et al. ..... 428/34.9
5,738,442 A * 4/1998 Paron et al. ..... 374/162
5,776,371 A * 7/1998 Parker ..... 252/502
5,821,849 A * 10/1998 Dietsch et al. ..... 37/241
5,873,892 A * 2/1999 Cohen ..... 606/234
5,880,667 A * 3/1999 Altavela et al. ..... 337/376
6,114,941 A * 9/2000 Scott ..... 337/332

* cited by examiner

*Primary Examiner*—Anatoly Vortman

(57) ABSTRACT

A temperature sensitive indicator 24 in the form of a label or decal is affixed to the outside of a thermal switch 20. The temperature sensitive label provides a permanent record of the temperature limits exposed to the thermal switch. The temperature sensitive material changes colors when the thermal switch is exposed to its predetermined temperature limit. The changed color provides a quick and clear indication of an event that caused switch activation. The color indication on the outside surface of the switch also provides a visual indication that is easy to acquire and inspect without the need to have physical access to the switch itself.

9 Claims, 3 Drawing Sheets

THERMAL SWITCH WITH ACTIVATION INDICATOR

This application is a continuation-in-part of and claims priority from Ser. No. 09/205,669 filed Dec. 4, 1998 now U.S. Pat No. 6,114,941, titled 'Thermal Switch with Activation Indicator', which in turn is a continuation of Ser. No. 60/067,956 filed Dec. 8, 1997, now abandoned, the entire specification of which is incorporated herein by reference.

FIELD OF THE INVENTION

BACKGROUND OF THE INVENTION

Thermal switches are used in a variety of applications where it is desirable to activate and/or deactivate equipment as a function of sensed temperature. Such applications may include: rocket motors and thrusters, battery charge rate control, temperature control for fuel systems, environmental controls, overheat protection as well as many others. In several thermal switch applications, it is desirable to know when the switch has been activated. For example, it is desirable to know when the switch is part of a safety system or is part of a control system used to protect delicate instrumentation. Often, there is no way of knowing that the switch has been tripped.

One application for thermal switches that clearly illustrates the disadvantages of prior art devices is duct leak overheat detection systems. The duct leak overheat detection system is part of the airplane deicing system. In this type of deicing system, hot air is forced pneumatically through a tube along the leading edge of the wing. Thermal switches located along this duct, indicate overheating, which could otherwise lead to fires and other system failures. When a thermal switch is tripped, a light illuminates in the cockpit indicating a "right" or "left" wing overheat condition. If, after shutting the system down on the appropriate wing, the switch does not reset, the airplane must divert to an emergency landing. Upon landing, the airplane maintenance personnel have no way of knowing which particular switch has been activated, because there exist multiple thermal switches linked to a particular cockpit light. The existing airplane systems have only provided the crew with an indication of the particular wing semispan along which a thermal switch was tripped. If the switch has reset, there is no indication to the maintenance personnel that it was tripped by the overheat condition. This dearth of information requires the crew to physically access and inspect the entire system along the appropriate wing semispan. Even in applications where only one temperature probe indicated an alarm temperature in-flight, extensive and expensive troubleshooting is sometimes necessary. For example, an airborne alert from a temperature probe in aircraft turbine bleed air ductwork may require engine run-up and monitoring on the ground to determine whether the probe and/or the bleed air system is faulty.

SUMMARY OF THE INVENTION

The present invention provides a ready indication that the thermal switch has experienced temperatures that triggered operation of the device. According to one aspect of the present invention, a temperature sensitive material in the form of a label or decal is affixed to the outside of the thermal switch. The temperature sensitive label provides a permanent record of the temperature limits that the switch has been exposed to. The temperature sensitive label changes colors when the thermal switch is exposed to its predetermined temperature limit. The changed color provides a quick and clear indication of an event that caused switch closure. The color indication on the outside surface of the switch also provides a visual indication that is easy to acquire and inspect without the need to have physical access to the switch itself.

According to another aspect of the present invention, the thermal switch of the present invention is especially suited for use as an overheat sensor in airplane deicing systems or in aircraft turbine engine bleed air ductwork. The maintenance crew can quickly locate and identify an activated switch according to decal that changed color.

DETAILED DESCRIPTION OF PREFERRED EMBODIMENTS

Figure 1:
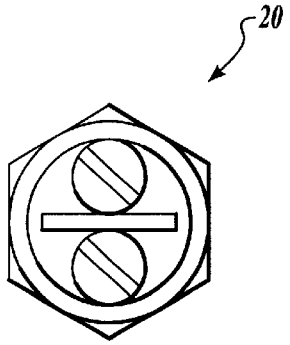
FIG. 1 is an end view of a thermal switch constructed according to one embodiment of the present invention.
Figure 2:
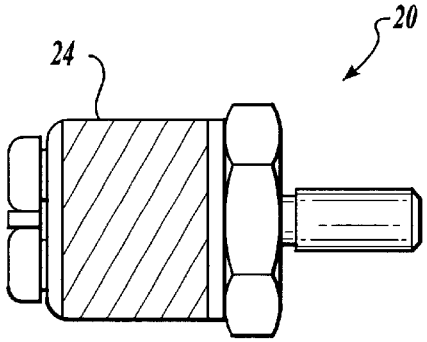
FIG. 2 is a side view of the thermal switch shown in FIG. 1.

FIGS. 1 and 2 show a thermal switch 20, around which is placed a temperature sensitive indicator 24 that changes color at a predetermined temperature. In a preferred embodiment of the present invention, the temperature sensitive indicator 24 is a decal (identified as temp label). According to alternative embodiments of the present invention, the temperature sensitive indicator 24 can be self adhesive or not, and can also be applied directly in a manner similar to paint.

In the preferred embodiment, the temperature sensitive indicator 24 is a decal with a Kapton overlay. After the decal is affixed to the thermal switch 20, a clear thin coating, (38) such as epoxy, is optionally applied. The epoxy serves to protect the temperature sensitive indicator 24 and enhances the robustness of the sensor and indictor combination.

Figure 3:
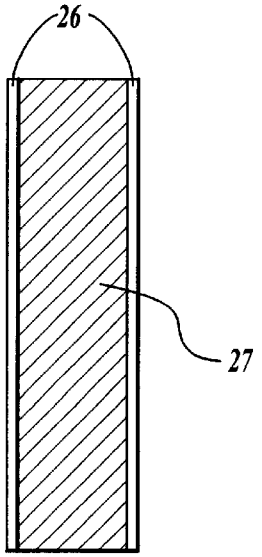
FIG. 3 shows a temperature sensitive label according to one embodiment of the present invention.

FIG. 3 shows an example of the temperature sensitive indicator 24 according to an embodiment of the invention. As shown in FIG. 3, the temperature sensitive indicator 24 includes border stripes 26. The border stripes 26 are preferably colored for coding purposes and are located on the longitudinal edge of the temperature sensitive indicator 24. Located between the border stripes 26 is a temperature sensitive material 27 which changes color at a predetermined temperature. This change in color can be a permanent or temporary change. The border stripes 26 provide the ability to visually determine the temperature configuration of the switch, which reduces the likelihood of installing a switch with an inappropriate temperature setting. Table 1 below shows an example of a color scheme useful for the border stripes 26 for indicating the temperature set point of the thermal switch according to the present invention.

TABLE 1

| BORDER STRIPE COLOR | TRANSITION TEMPERATURE ± 1% |
|---|---|
| GREEN | 190° F. |
| YELLOW | 240° F. |
| RED | 290° F. |

Other color coding schemes may be used to indicate thermal switch temperature settings. The invention is not limited merely to the use of the stripes 26 as shown.

In operation, the temperature sensitive material 27 changes from a first color, for example, white, to a second color, for example, black, when the rated temperature is reached. In particular, according to the embodiment shown in Table 1, a thermal switch having a temperature sensitive material with green border stripes is activated at a temperature of 190° F. Upon attaining 190° F.±2 degrees, the temperature sensitive material 27 changes color from white to black. The thermal switch need not have the same temperature tolerance as the temperature sensitive material attached to it.

A permanent and irreversible indication of an overtemperature event is provided once the temperature sensitive material changes color. The color change is readily apparent when the thermal switch is located in an easily visible position.

Figure 4:
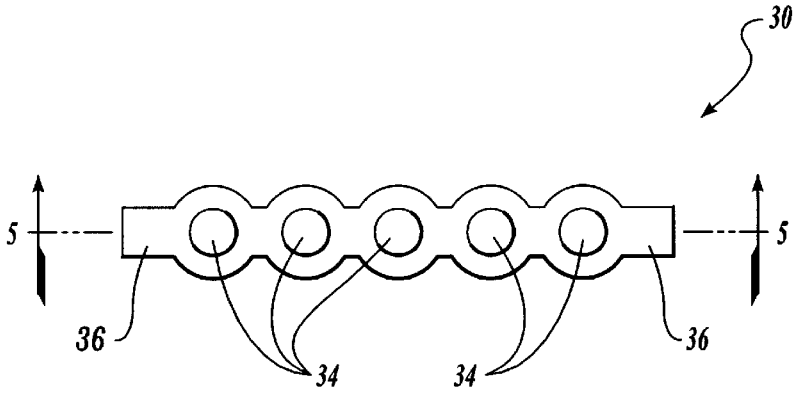
FIG. 4 is a top view of an alternate embodiment temperature sensitive label.
Figure 5:
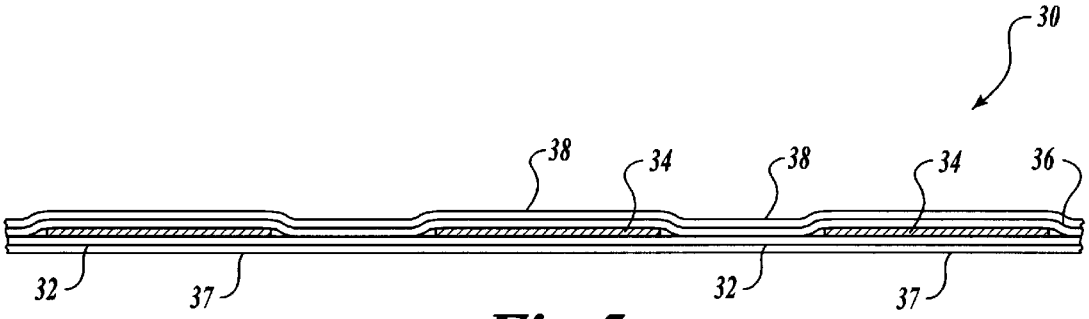
FIG. 5 is a cross-sectional view of the label shown in FIG. 4.
Figure 6:
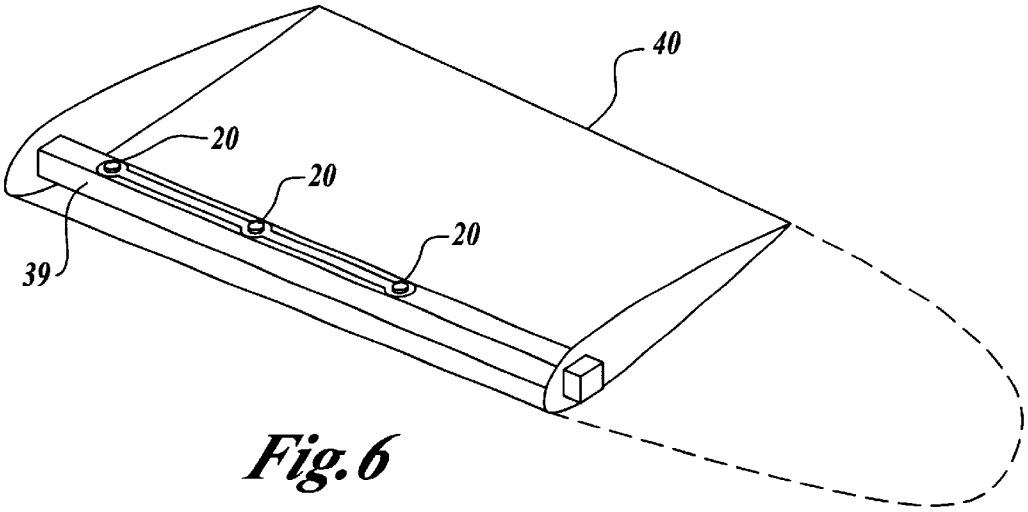
FIG. 6 is a view of a thermal switch system installed on an airplane de-icing system.
Figure 7:
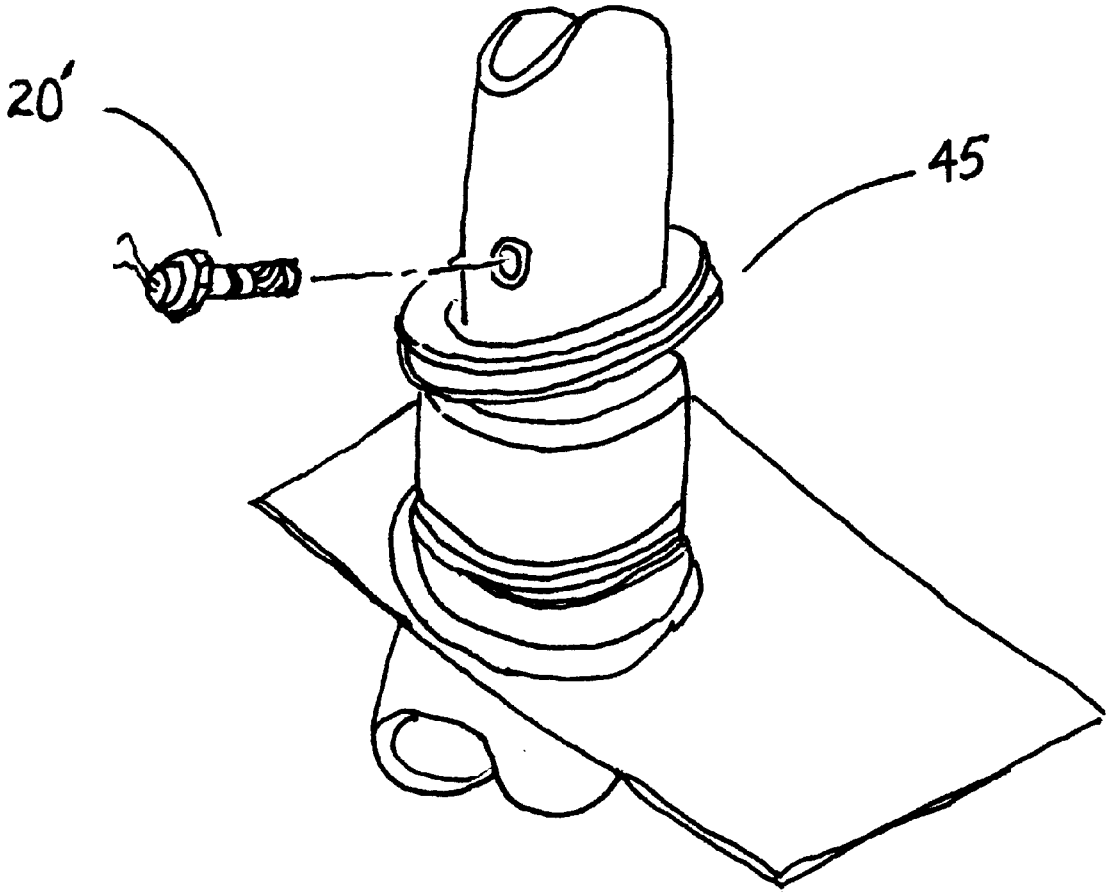
FIG. 7 is a view of the thermal switch (20') installed in an aircraft turbine bleed air duct (45).
Figure 8:
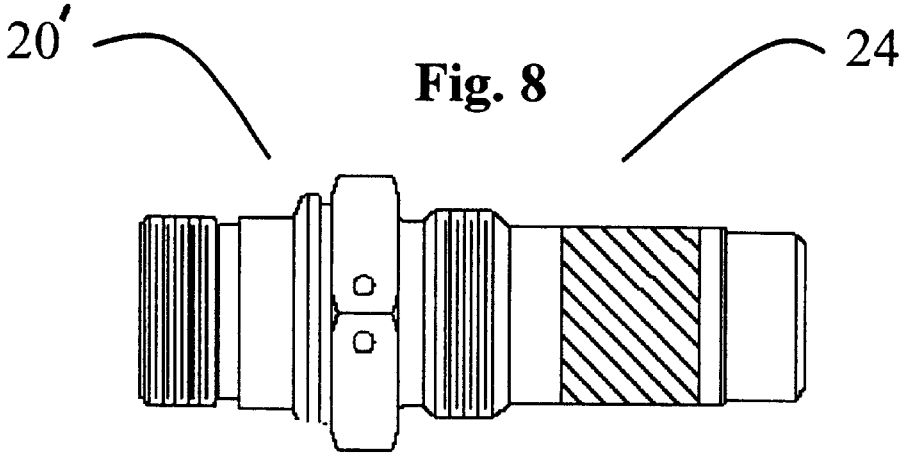
FIG. 8 is a side view of the thermal switch for use in an aircraft bleed air duct.

FIGS. 4 and 5 are alternate examples of an alternate temperature sensitive indicator 30 formed in accordance with the present invention. The temperature sensitive indicator 30 includes a bottom layer 32, temperature sensitive chemical indicators 34 and a cover 36. The bottom layer 32 and cover 36 preferably formed of a heat stabilized polyester film, such as Kapton. A clear thin coating (38), such as epoxy, is optionally applied. Both sides of the bottom layer include a pressure sensitive and/or vapor barrier adhesive (37) with one side bonded to the cover and the other side bonded to the temperature sensitive device. The cover 36 is colored and is formed into a series of connected donut shapes. Each of the chemical indicators 34 is formed approximately as a circle with a radius larger than the radius of openings in the donut shapes of the cover 36. The chemical indicators 34 are positioned between the bottom layer 32 and the donut shapes of the cover 36. The chemical indicators 34 change color or shade at a predefined temperature. FIG. 6 illustrates an embodiment of the thermal switch system as installed on the airplane deicing system (39) of an airplane (40). FIG. 7 illustrates another exemplary embodiment of the thermal switch (20') as installed in an airplane turbine bleed air duct (45). FIG. 8 illustrates an exemplary coupling location for the temperature sensitive material (24) for the thermal switch (20') that can be installed in an airplane turbine bleed air duct (45).

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent is:

1. An overheat sensing system for sensing the thermal condition of the turbine bleed air duct system in an airplane, said overheat sensing system comprising:

a thermal switch coupled to the turbine bleed air duct system for detecting when an external threshold temperature associated with said thermal switch has been reached, wherein said external threshold temperature is caused from other than an electric current through said switch; and a temperature sensing material coupled to the surface of said thermal switch for indicating if said thermal switch has been exposed to temperatures above the threshold temperature associated with the turbine bleed air duct system.

2. A method of sensing a prior thermal condition of one or more components of a device, said method comprising:

coupling a temperature sensing material to a thermal switch to form a thermal switch apparatus, said temperature sensing material selected to change color at a threshold temperature;

coupling said thermal switch apparatus to the components of the device;

changing the color of said temperature sensing material when exposed to an external threshold temperature caused from other than an electric current through said thermal switch; and identifying by visual inspection of the temperature sensing material whether said thermal switch apparatus has been exposed to said external threshold temperature.

3. The sensing method of claim 2, wherein said step of coupling said temperature sensing material to said thermal switch is by means of an adhesive label.

4. The sensing method of claim 2, wherein said step of changing the color of said temperature sensing material is a permanent change.

5. The sensing method of claim 2, wherein said step of changing the color of said temperature sensing material is a temporary change.

6. The sensing method of claim 2, wherein said threshold temperature of said temperature sensing material is substantially equal to a setpoint of said thermal switch.

7. The sensing method of claim 2, wherein said step of identifying by visual inspection additionally comprises comparing a color coding coupled to said thermal switch, indicating a setpoint of said thermal switch.

8. A method of sensing a prior thermal condition of an aircraft turbine bleed air duct system, said method comprising:

coupling a temperature sensing material to a thermal switch to form a thermal switch apparatus, said temperature sensing material selected to change color at a threshold temperature corresponding to a high-temperature condition in the bleed air duct system;

coupling said thermal switch apparatus to the components of the bleed air duct system;

changing the color of said temperature sensing material when exposed to said threshold temperature caused from other than an electric current through said thermal switch; and identifying by visual inspection of the temperature sensing material whether said thermal switch apparatus has been exposed to said external threshold temperature.

9. The sensing method of claim 8, wherein said step of identifying by visual inspection additionally comprises removing said thermal switch apparatus from the bleed air duct system prior to visually checking said color of said temperature sensing material.

* * * * *